US005241770A

United States Patent [19]

Lambert

[11] Patent Number: 5,241,770

[45] Date of Patent: Sep. 7, 1993

[54] GUN LOCKING APPARATUS

[76] Inventor: Carl L. Lambert, 385 Main Rd., Savoy, Mass. 01256

[21] Appl. No.: 850,577

[22] Filed: Mar. 13, 1992

[51] Int. Cl.[5] ..... F41A 17/44

[52] U.S. Cl. ..... 42/70.11; 42/96

[58] Field of Search ..... 42/70.11, 95, 96

[56] References Cited

U.S. PATENT DOCUMENTS 2,530,560 11/1950 Young ..... 42/70.11
2,836,918 6/1958 Pula et al. ..... 42/70.11
5,138,785 8/1992 Paterson ..... 42/70.11

FOREIGN PATENT DOCUMENTS 8600396 1/1986 PCT Int'l Appl. ..... 42/70.11

*Primary Examiner*—Stephen C. Bentley

*Attorney, Agent, or Firm*—Leon Gilden

[57] ABSTRACT

An outer tube complementarily and slidably receives a central mandrel in complementary coaxial relationship, wherein the outer tube includes collet spring fingers mounted at a lower distal end thereof, wherein the outer tube upon projection of the central mandrel therethrough effects a spreading of the collet fingers for engagement with a rear terminal end of an associated pistol cylinder or barrel of a long arm such as a rifle. The collet fingers include annular flanges to be received within the rear face of the cylinder or chamber for locking the organization within the pistol structure. Coaxially aligned bores of the outer tube and the central mandrel when aligned permit positioning of a latch therethrough preventing removal of the organization in a pistol.

2 Claims, 4 Drawing Sheets

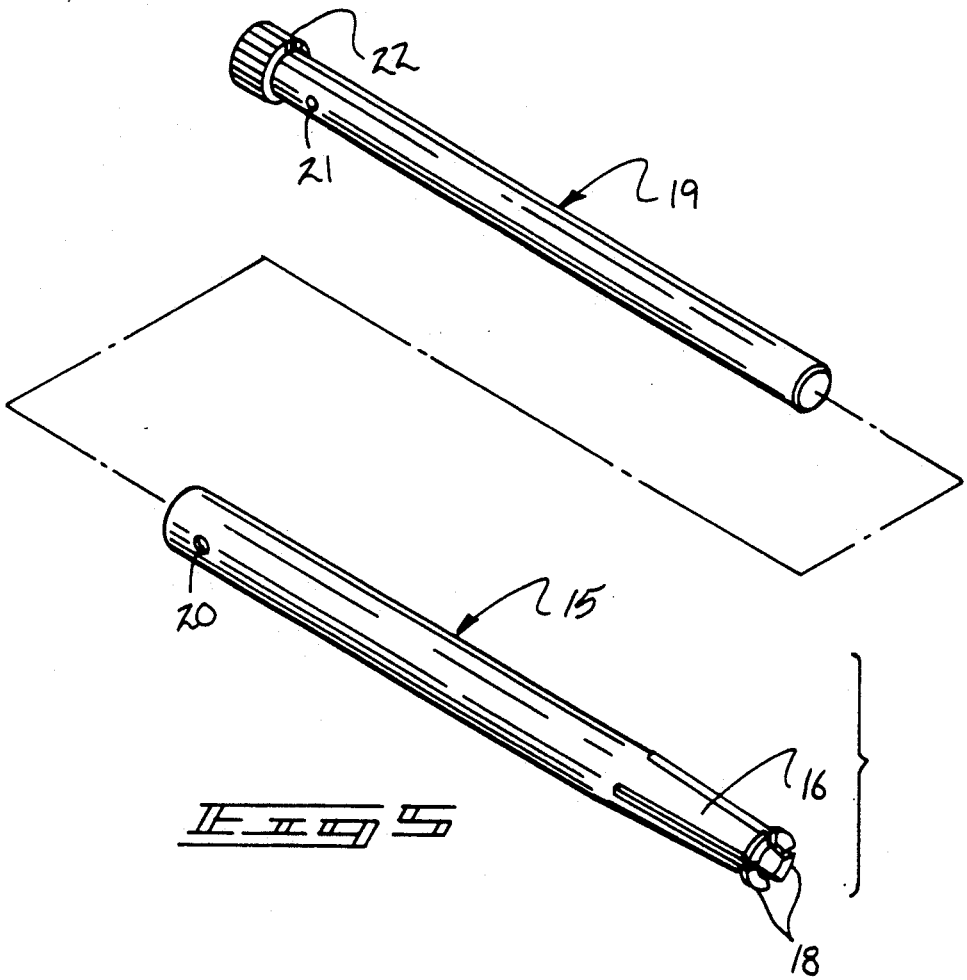
Fig 5
Fig 4
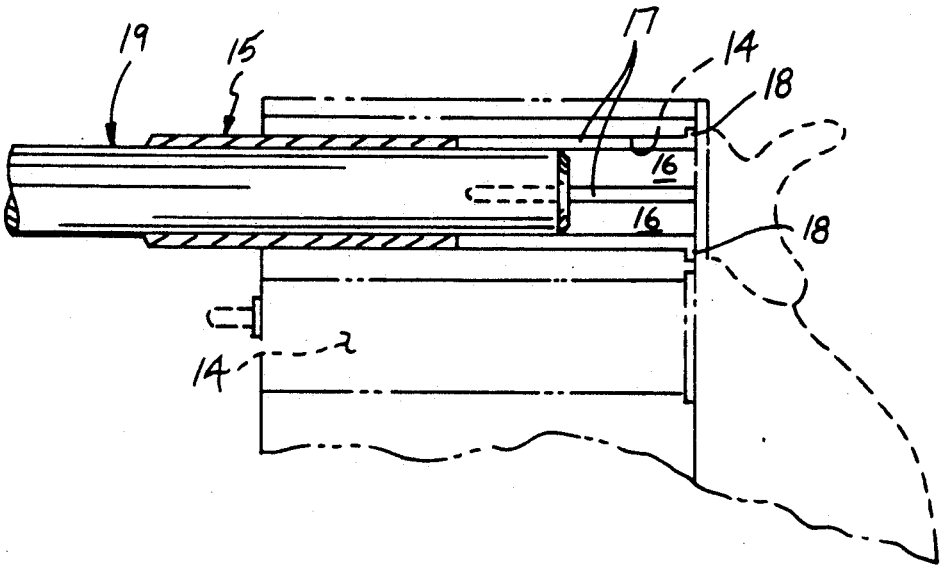

GUN LOCKING APPARATUS

BACKGROUND OF THE INVENTION

1. Field of the Invention

The field of invention relates to gun locking apparatus, and more particularly pertains to a new and improved gun locking apparatus wherein the same is arranged for latching securement of a rod member within an aligned pistol barrel and cylinder. It should be noted that the apparatus avails itself of being received with any firearm barrel and aligned chamber such as in a rifle for example.

2. Description of the Prior Art

Various gun locking structures are provided directed through a barrel and cylinder of an associated pistol arrangement. The instant invention attempts to overcome deficiencies of the prior art by setting forth a unitary collet locking structure that is latched selectively to the pistol preventing inadvertent and unauthorized removal therefrom.

Prior art structure is exemplified by the U.S. Pat. No. 4,398,366 to Werincki wherein a gun lock includes a plurality of latch cylinders cooperative with a dummy projectile received within the pistol.

U.S. Pat. No. 4,512,099 to Mathew sets forth a split sleeve structure directed into a pistol utilizing a turnkey lock member to lock the structure upon sliding engagement of the lock portion within the associated gun cylinder.

U.S. Pat. No. 4,908,971 to Chaney illustrates the use of a plug member directed into a pistol barrel and cooperating with the associated cylinder to latch the organization together.

As such, it may be appreciated that there continues to be a need for a new and improved gun locking apparatus as set forth by the instant invention which addresses both the problems of ease of use as well as effectiveness in construction to effect the inter-locking of a revolver pistol barrel relative to the associated revolved cylinder and in this respect, the present invention substantially fulfills this need. The invention in short prevents a loading of ammunition in a firearm chamber.

SUMMARY OF THE INVENTION

In view of the foregoing disadvantages inherent in the known types of gun locking apparatus now present in the prior art, the present invention provides a gun locking apparatus wherein the same utilizes a collet structure arranged to be expanded for engagement of a rear face of an associated pistol cylinder or gun chamber. As such, the general purpose of the present invention, which will be described subsequently in greater detail, is to provide a new and improved gun locking apparatus which has all the advantages of the prior art gun locking apparatus and none of the disadvantages.

To attain this, the present invention provides an outer tube complementarily and slidably receiving a central mandrel in complementary coaxial relationship, wherein the outer tube includes collet spring fingers mounted at a lower distal end thereof, wherein the outer tube upon projection of the central mandrel therethrough effects a spreading of the collet fingers for engagement with a rear terminal end of an associated pistol cylinder. The collet fingers include annular flanges to be received within the rear face of the cylinder for locking the organization within the pistol structure. Coaxially aligned bores of the outer tube and the central mandrel when aligned permit positioning of a latch therethrough preventing removal of the organization in a pistol.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gun locking apparatus which has all the advantages of the prior art gun locking apparatus and none of the disadvantages.

It is another object of the present invention to provide a new and improved gun locking apparatus which may be easily and efficiently manufactured and marketed.

It is a further object of the present invention to provide a new and improved gun locking apparatus which is of a durable and reliable construction.

An even further object of the present invention is to provide a new and improved gun locking apparatus which is susceptible of a low cost of manufacture with regard to both materials and labor, and which accordingly is then susceptible of low prices of sale to the consuming public, thereby making such gun locking apparatus economically available to the buying public.

Still yet another object of the present invention is to provide a new and improved gun locking apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an enlarged cross-sectional view of the collet structure engaged to the rear face of the associated pistol cylinder.

FIG. 5 is an isometric exploded view of the invention.

DESCRIPTION OF THE PREFERRED EMBODIMENT

Figure 1:
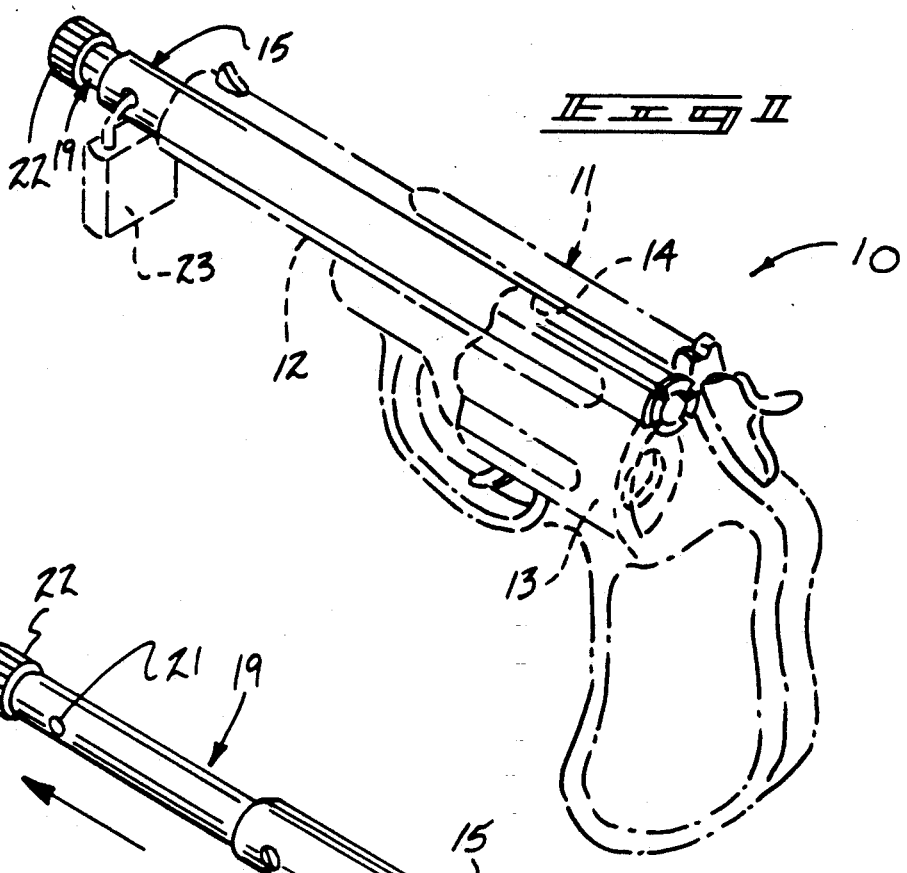
FIG. 1 is an isometric illustration of the invention mounted within an associated revolver fire arm.

With reference now to the drawings, and in particular to FIGS. 1 to 9 thereof, a new and improved gun locking apparatus embodying the principles and concepts of the present invention and generally designated by the reference numerals.

Figure 2:
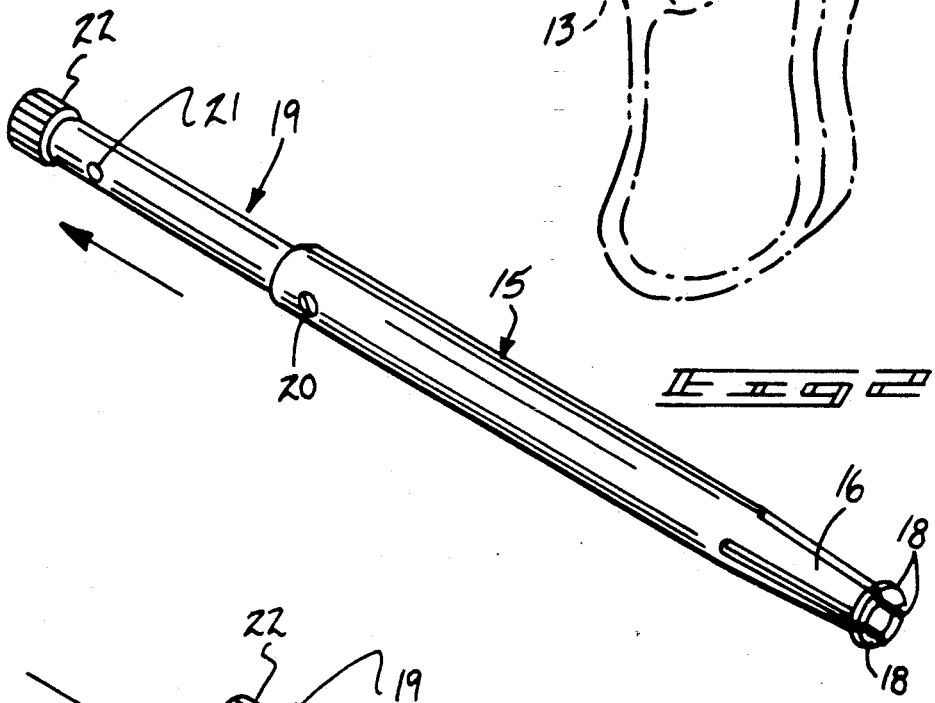
FIG. 2 is an isometric illustration of the invention in a first position.
Figure 3:
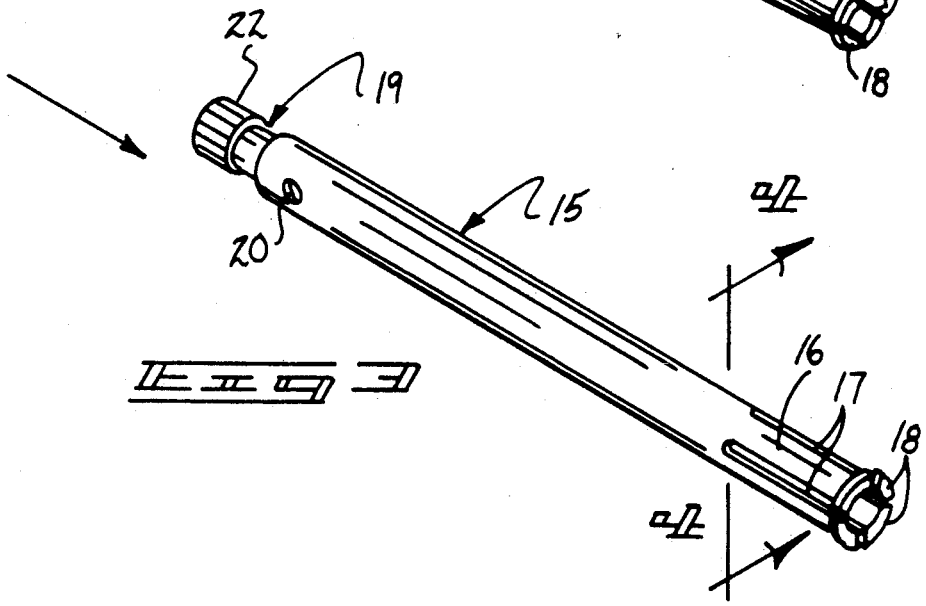
FIG. 3 is an isometric illustration of the invention in a second locked position.

More specifically, the gun locking apparatus of the instant invention essentially comprises the organization mounted within a pistol 11 that is formed with a pistol barrel 12 cooperative with a revolving cylinder 13, wherein the barrel 12 is selectively and sequentially aligned with a cylinder chamber 14 of a plurality of cylinder chambers, such as illustrated in FIG. 4. The pistol 11 is of a conventional type noted as a "revolver". The apparatus of the invention includes a cylindrical outer tube 15. The outer tube 15 is defined by an outer tube length and wherein the outer tube length is greater than a predetermined length that is defined between a forward distal end of the pistol barrel 12 and a rear face of the revolving cylinder 13 to permit projection exteriorly of the pistol barrel 12, the outer tube 15 when presented within the barrel and chamber structure. The cylindrical outer tube 15 includes a plurality of concentric collet spring fingers 16 formed at a forward distal end of the outer tube 15 defining slots 17 between adjacent spring fingers 16, wherein the slots 17 are coextensive with the spring fingers and define adjacent spring fingers, as illustrated in FIG. 2. Each spring finger forward distal end defines an arcuate flange 18 extending radially and exteriorly of each spring finger, whereupon the arcuate flanges 18 when in a spread second position (see FIGS. 3 and 4) extend to a rear face or gun chamber rim of the associated chamber 14 to engage a rear face of the chamber and thereby latch the outer tube 15 within the pistol 11. The spreading of the spring fingers 16 is effected by the use of a cylindrical central mandrel 19 complementarily, coaxially, and slidably directed within the cylindrical outer tube 15. The outer tube 15 includes a plurality of diametrically aligned outer tube bores 20 directed diametrically through the outer tube adjacent a rear distal end thereof oriented orthogonally relative to an axis of the outer tube that is arranged for alignment with a central mandrel bore 21 orthogonally oriented relative to a central mandrel axis, whereupon alignment of the central mandrel bore 21 with the outer tube bores 20, a lock member 23 may be directed therethrough for the inter-engaging and latching of the mandrel 19 relative to the outer tube 15. A handle 22 formed at a rear distal end rearwardly of the central mandrel bore 21 enhances manual engagement and disengagement of the central mandrel in use. The central mandrel bore 21 is spaced from a forward distal end of the central mandrel 19 a first length, wherein the aligned outer tube bores 20 are spaced from the collet spring fingers 15 a second length, wherein the second length is only slightly greater than the first length, whereupon alignment of the central mandrel bore 21 with the outer tube bores 20, the central mandrel 19 will thereby project to within the rear distal end of the spring fingers 16 to effect a spreading of the spring fingers, in a manner as illustrated in FIG. 4. The central mandrel 19 not projecting beyond the forward end of the outer tube bore 20 precludes the firing pin of the firearm from striking the end of the invention. In an event where the firearm is "dry-fired" or operated for test, damage to the firearm's firing pin is prevented.

Figure 7:
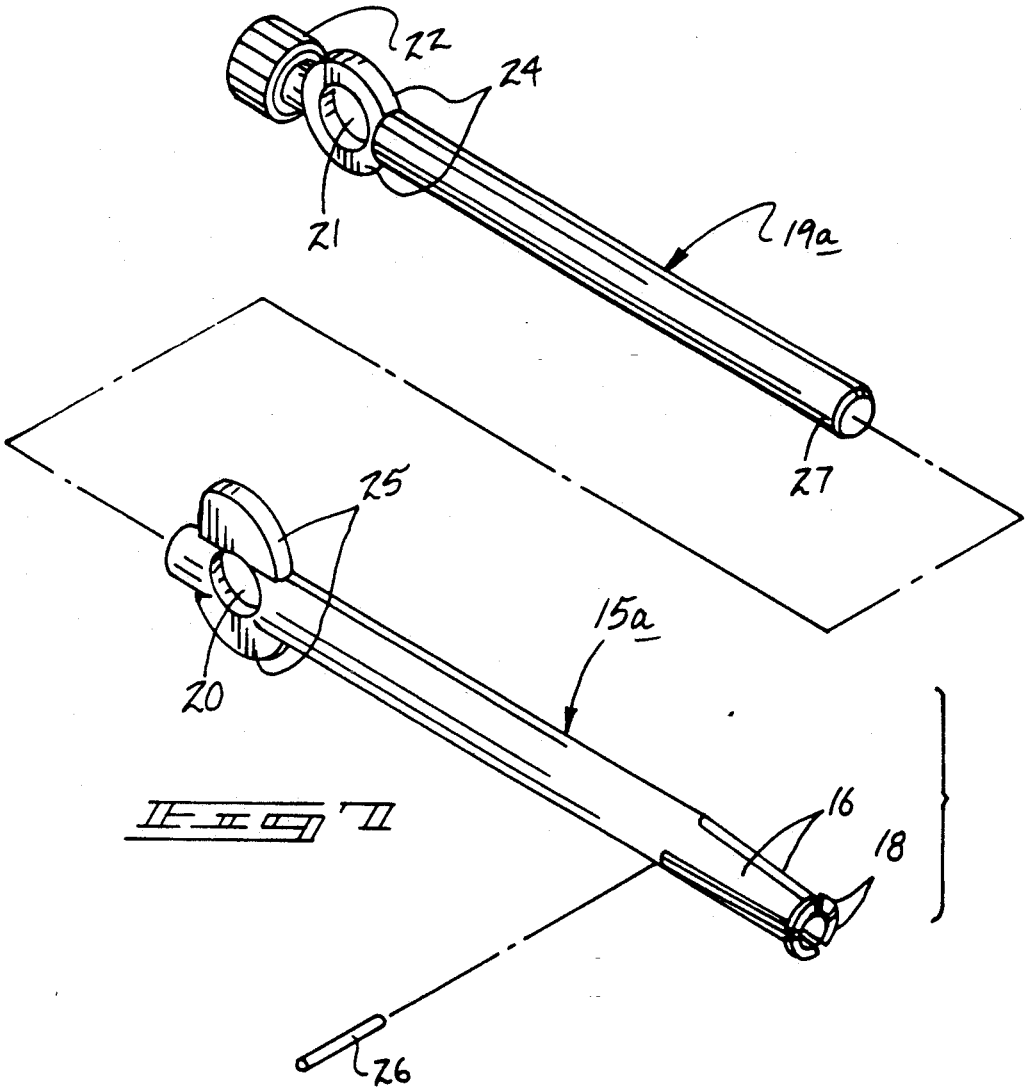
FIG. 7 is an isometric exploded illustration of the modified invention as set forth in FIG. 6.
Figure 6:
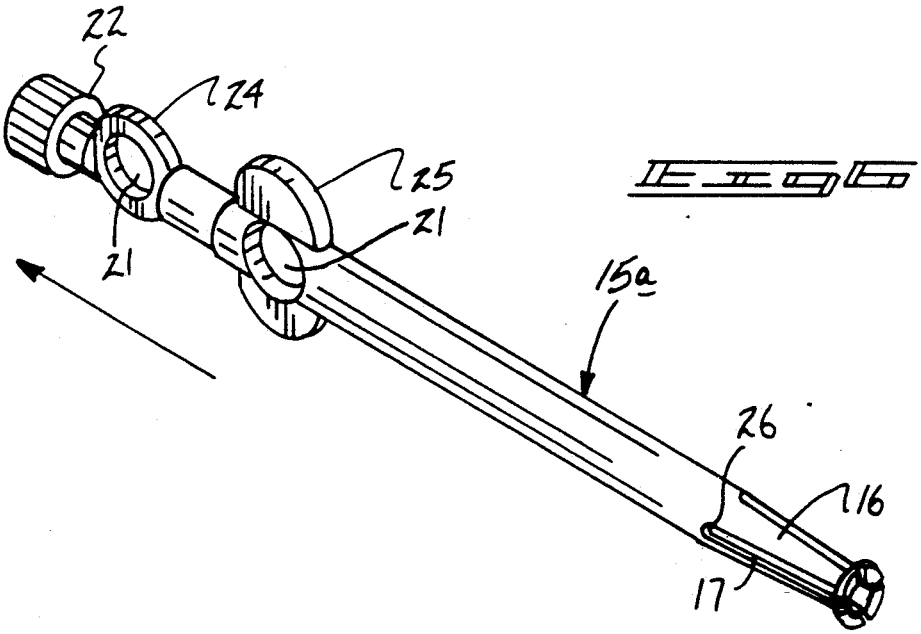
FIG. 6 is an isometric modification of the invention.
Figure 8:
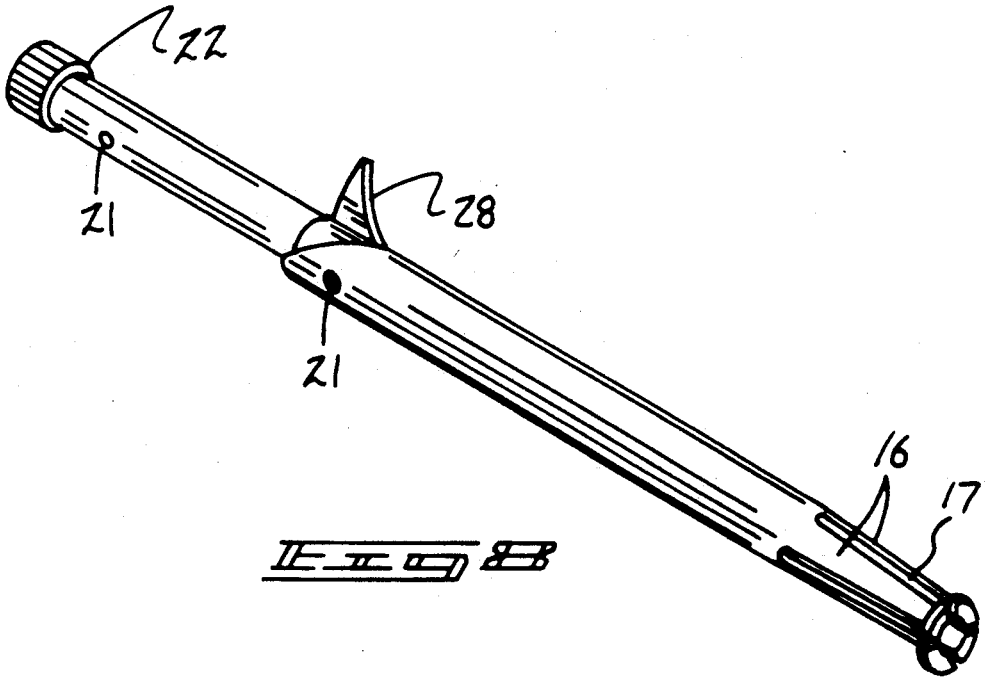
FIG. 8 is an isometric illustration of a further modified outer tube structure.
Figure 9:
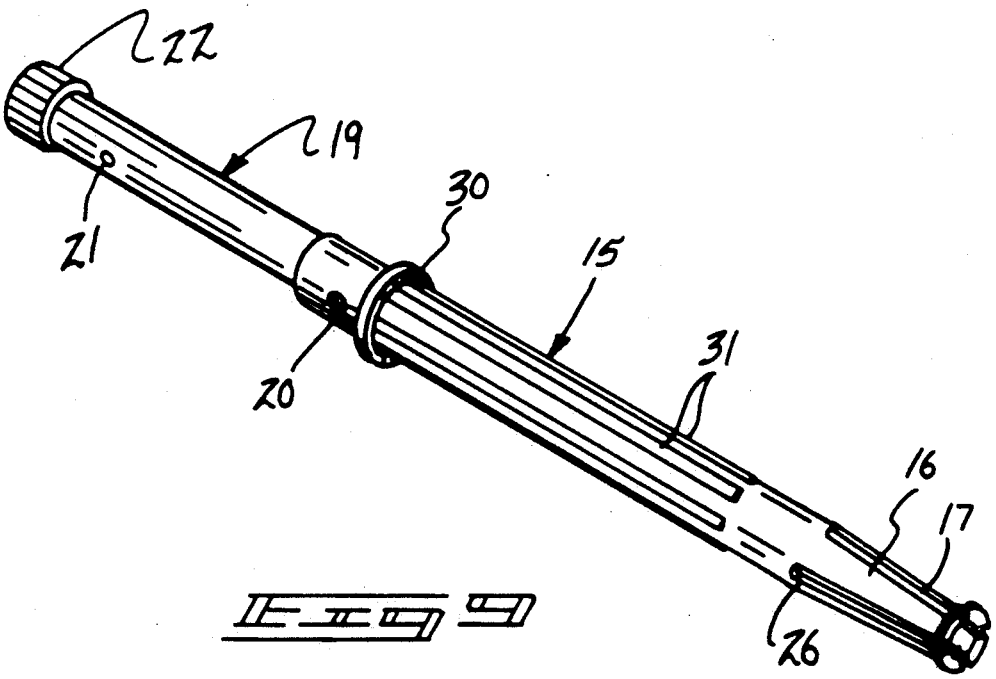
FIG. 9 is an isometric illustration of a yet further modified outer tube structure.

The FIGS. 6 and 7 illustrate the use of a modified outer tube 15 that includes a plurality of outer tube wings 25 that are diametrically aligned with and positioned at opposed sides of the outer tube bores 20 that are of a hollow configuration to complementarily receive the mandrel wings 24 directed diametrically opposed relative to the central mandrel bore 21. The wings 25 allow the provision of larger diameter tube bores 21 and 20 to accommodate larger diameter latching devices 23. Reception of the mandrel wings 24 within the outer tube wings 25 provides for forward projection and abutment of the mandrel 19*a* to be received within the outer tube 15*a*. Further, an outer tube pin 26 that is fixedly mounted with and projecting radially of a mandrel receiving bore 27 is slidably projected within one of the aforenoted slots 17 to thereby limit removal of the central mandrel 19*a* relative to the outer tube 15*a*.

It may be further noted that the outer tube may be further provided with a polymeric covering 28 to prevent marring of an interior bore surface of the associated pistol, or selectively, may include a plurality of parallel lubricant strips 31 formed of a resilient polymeric lubricant impregnated material that are arranged relative to one another and to the axis of the outer tube 15. An abutment flange 30 is illustrated in lieu of the mandrel wing structure, as illustrated in the FIGS. 6 and 7, to limit projection of the outer tube within the pistol. The lubricant surface 31 is arranged to provide for lubrication interiorly of the pistol to minimize corrosion during periods of prolonged storage.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A gun locking apparatus for projection within a pistol, wherein the pistol includes a pistol barrel and a pistol chamber positioned rearwardly of the pistol barrel, wherein the locking apparatus is arranged for projection within the pistol barrel and the pistol chamber, and wherein the apparatus comprises, a cylindrical outer tube, the cylindrical outer tube including a plurality of collet spring features formed at a forward end portion of the cylindrical outer tube concentrically arranged relative to one another, wherein the outer tube defines an outer tube axis and the collet spring fingers are oriented concentrically about the outer tube axis, and a slot defined between adjacent collet spring fingers, and a cylindrical central mandrel slidingly, coaxially, and complementarily received within the cylindrical outer tube for projection of the cylindrical central mandrel between the collet spring fingers to effect a spreading of the collet spring fingers within the pistol revolving cylinder, and each of the collet spring fingers includes an arcuate flange formed at a forward distal end of each of the collet spring fingers, wherein each arcuate flange extends radially and exteriorly of said each spring finger, and the cylindrical outer tube includes a plurality of aligned outer tube bores directed through the outer tube adjacent a rear distal end of the outer tube, wherein the outer tube bores are diametrically aligned relative to the outer tube and orthogonally relative to the outer tube axis, and the central mandrel including a central mandrel bore diametrically directed through the central mandrel adjacent a rear terminal end of the central mandrel, wherein the central mandrel bore is arranged for coaxial alignment between the outer tube bores, and the central mandrel bore is spaced from a forward distal end of the central mandrel a first length, and the outer tube bores are spaced from the spring fingers a second length, wherein the first length is only slightly less than the second length, whereupon alignment of the central mandrel bore within the outer tube bores effects projection of the central mandrel between the collet spring fingers to effect spreading of the collet spring fingers, and a lock member directed through the outer tube bores and the central mandrel bore when the central mandrel bore and the outer tube bores are coaxially aligned, and the forward distal end of the central mandrel includes a lock pin orthogonally oriented relative to a central mandrel axis defined by the central mandrel, and wherein the lock pin is slidingly received within said slot arranged between adjacent spring fingers.

2. An apparatus as set forth in claim 1 including a plurality of parallel lubricant impregnated strips mounted to an exterior surface of the outer tube between the spring fingers and the outer tube bores, and further including an abutment flange mounted circumferentially to the outer tube extending exteriorly thereof between the strips and the outer tube bores.

* * * * *